United States Patent [19]

Vuille et al.

[11] 4,005,778

[45] Feb. 1, 1977

[54] COFFER FOR STORING NUMISMATICAL COINS

[75] Inventors: Claude H. Vuille, Fribourg; Frederic T. Kropp, Corpataux, both of Switzerland

[73] Assignee: Michael Pfeiffer, Ottobrunn, Switzerland

[22] Filed: Mar. 31, 1975

[21] Appl. No.: 563,496

[30] Foreign Application Priority Data

Apr. 5, 1974 Germany ..... 2416752

[52] U.S. Cl. ..... 206/.84; 206/503

[51] Int. Cl.[2] ..... A45C 11/00; B65D 85/62

[58] Field of Search ..... 206/.83, .84, 1.5, 503; 217/13, 12 R, 70, 65; 312/122, 111; 292/159

[56] References Cited

UNITED STATES PATENTS

| | | | |
|---|---|---|---|
| 1,686,515 | 10/1928 | Chamdler | 312/111 |
| 2,512,028 | 6/1950 | MacMillan | 206/1.5 |
| 2,521,792 | 9/1950 | Hollander | 206/.83 |

*Primary Examiner*—William T. Dixson, Jr.
*Attorney, Agent, or Firm*—Bruce & McCoy

[57] ABSTRACT

A coffer for storing or holding numismatical coins, medals or the like comprises a plurality of U-shaped frames and a tablet in each frame, the frames being securely, but releasably affixed to each other and forming the side and back walls of the coffer, the upper and lower side of which is covered by a bottom, and cover wall respectively. The number of U-frames and tablets may be selected, and varied as desired. In a preferred embodiment a locking means is provided in each U-shaped frame, the locking means of the various frames being adapted to cooperate with each other, and a central locking means in the cover wall.

14 Claims, 16 Drawing Figures

COFFER FOR STORING NUMISMATICAL COINS

BACKGROUND OF THE INVENTION

This invention relates to coffers for holding or storing numismatical coins, medals or the like, and particularly to a coffer of this type having a plurality of tablets each for holding a plurality of coins.

Coffers of this type comprise a bottom wall, a cover wall, side and back walls connecting same and a predetermined number of tablets holding coins, which tablets are adapted to slide between said walls. These prior art coffers include a solid back wall and solid side walls, the side walls each including guiding means for the predetermined number of tablets. Such a coffer is disclosed in German Utility Model No. 1,993,025.

The disadvantage of this prior art coffer resides in that the box type enclosure in any case is adapted only for an exactly predetermined number of tablets and thus has a fixed size. For smaller size numismatical collections such a coffer is usually too big, in many cases it further takes up too much space. Similar difficulties arise when the collection slightly exceeds the standard capacity of such a coffer: either some of the coins must be stored outside the coffer, or a complete coffer must be obtained and, above all, stored.

Therefore single coin holding tablets have been proposed which may be stacked upon each other. If a plurality of such tablets are stacked on each other, it is only the uppermost tablet which is accessible, to gain access to the other tablets, all tablets stacked on top of that must first be removed. Such tablets are disclosed in German Utility Model No. 1,960,379.

SUMMARY OF THE INVENTION

It is, therefore, an object of the invention to provide a coffer for storing numismatical coins, medals or the like which is adapted to collections of any size and in which simultaneously each individual tablet is separately accessible.

According to one aspect of the invention a coffer for storing numismatical coins comprises a bottom wall, a cover wall, side and back walls joining them, and at least one tablet for holding coins slidable between said walls, and said bottom wall and cover wall form separate components while for each tablet there is provided a U-shaped frame which is securely fastened to the bottom and cover wall, and/or other similar frames above or below it, respectively, and including a guiding means for the tablet, the side walls of the coffer being defined by the legs, and the back wall defined by the crosspieces of the individual U-shaped frames. In this manner a closed coffer may be assembled for practically any desired number of tablets which are individually accessible without using substantially more space than occupied directly by the tablets.

The tablets themselves may be designed in any desired manner, thus they may include partitions or compartments for taking up individual coins, or may be adapted to take up prefabricated inserts for individual coins or sets of coins.

As bottom or cover wall a relatively thin plate should be sufficient, if measures are provided to make the joint to the edges and frames sufficiently strong. Such a strong joint is obtained with the least expense if the bottom wall and/or the cover wall are each made integral with a frame. It should be noted that it is sufficient to do that at the bottom wall or the cover wall; if desired, a coffer may then be assembled having only one single tablet, still maintaining the stability obtained by integral forming.

Generally it is to be considered that the size of the collection to be stored in the coffer changes with time, and to adapt the coffer to such a change, according to one feature of the invention, each frame is releasably positively connected to the cover wall, bottom wall, or other frames respectively. As the connection is releasable, it is possible to remove individual frames from the coffer, to dissolve the coffer in part, and to add new frames, respectively, and by the positive joint the necessary solidity is ensured.

For a positive joint of the frames a variety of possibilities are available. Advantageously at the crosspiece of each frame a lug is disposed in the plane of the frame, and a correspondingly shaped recess is provided in the opposite side of the crosspiece, the bottom wall and the cover wall presenting the same recess, and lug, respectively, and locking means are provided at the front side of the legs of each frame, the bottom wall, and the cover wall. For assembling a frame when only the lug of the frame is inserted into the recess of the adjacent frame, then the two adjacent frames are folded together, and the locking means on the front side is closed.

In the preferred embodiment of the invention each leg is provided with a recess adjacent the free end thereof, and on the opposite side a projection fitting into same, and at least in the leg portion between recess and free end, and the projection each have a bore parallel to the axis of the leg, and there is provided a locking bolt fitting into both bores. After folding adjacent frames together only the locking bolts need be inserted, and the desired secure joint of the adjacent frames is complete. The same holds, of course, for the positive joint to the bottom and cover wall.

The locking bolt must, of course, fit to one of the bores so that it is held therein. The simplest way to achieve that is to provide for frictional engagement, and then it is advantageous to make the locking bolt out of an other material than the frame and the tablets. This is particularly true for components made of plastic since frictional engagement of identical plastic materials has a tendency for jamming.

In a specific embodiment of the invention the locking bolt includes a head having a nose defining an extension of the tablet guiding means of a frame. This has the advantage that the frame may be kept correspondingly smaller so that in the disassembled condition it takes up less space.

If and when in this or another manner the locking bolt takes part in guiding the tablet, it is possible to keep the individual tablets in their slid-in position only by frictional engagement without the already mentioned danger of jamming. It is then only necessary to fit each tablet loosely to the frame guiding means, and with close fit to the head of the locking bolt at which due to the different materials no jamming may occur.

To obtain such guiding of the tablet by the head of the locking bolt, it is necessary to define the position of the head of the locking bolt in a precise manner, and to obtain that advantageously each locking bolt has a means to prevent rotation. Various possibilities are available to achieve that, it is convenient to use for this purpose a pin fitting into a bore extending into the front side of the frame leg. This pin simultaneously may be utilised to assure the correct position of the locking bolt in the assembled coffer in the first place.

The coffer according to the invention is well adapted for storing of a coin collection, during transport problems may be encountered because the individual tablets are only frictionally kept in position, so that there is the danger that upon substantial shocks or the like individual tablets may become loose from the coffer.

To resolve that in a specific embodiment of the invention there is therefore disposed in at least one leg of each U-shaped frame a rotational lock which extends, in one rotational position, in a recess at the side edge of the slid-in tablet, which rotational lock presents, on its upper face, a recess having non-round cross-section, and on the lower face a projection shaped corresponding to the recess in the rotational lock of the frame disposed thereunder. When in such a coffer the rotational lock in the lowest or uppermost frame is rotated, all other rotational legs are rotated jointly therewith and extend into the recess of the associated tablet, or are rotated out of engagement into this recess.

In addition it is possible to prevent unauthorised access to the coffer by mounting a key lock at the cover wall which lock has a projection shaped corresponding to the recess of a rotational lock disposed thereunder and engaging same.

During transporting the closed coffer the rotational locks are maintained in their position by the frame above, and cover, and bottom plate, respectively, when individual frames are shipped or transported, it may happen, however, that the rotational lock falls out of the frame. To prevent that at each rotational lock there may be provided a groove extending around a portion of its periphery, and a pin engaging said groove is inserted into each frame. Such a pin keeps the rotational lock in each rotational position positively in the frame, so that it cannot be lost.

Figure 1:
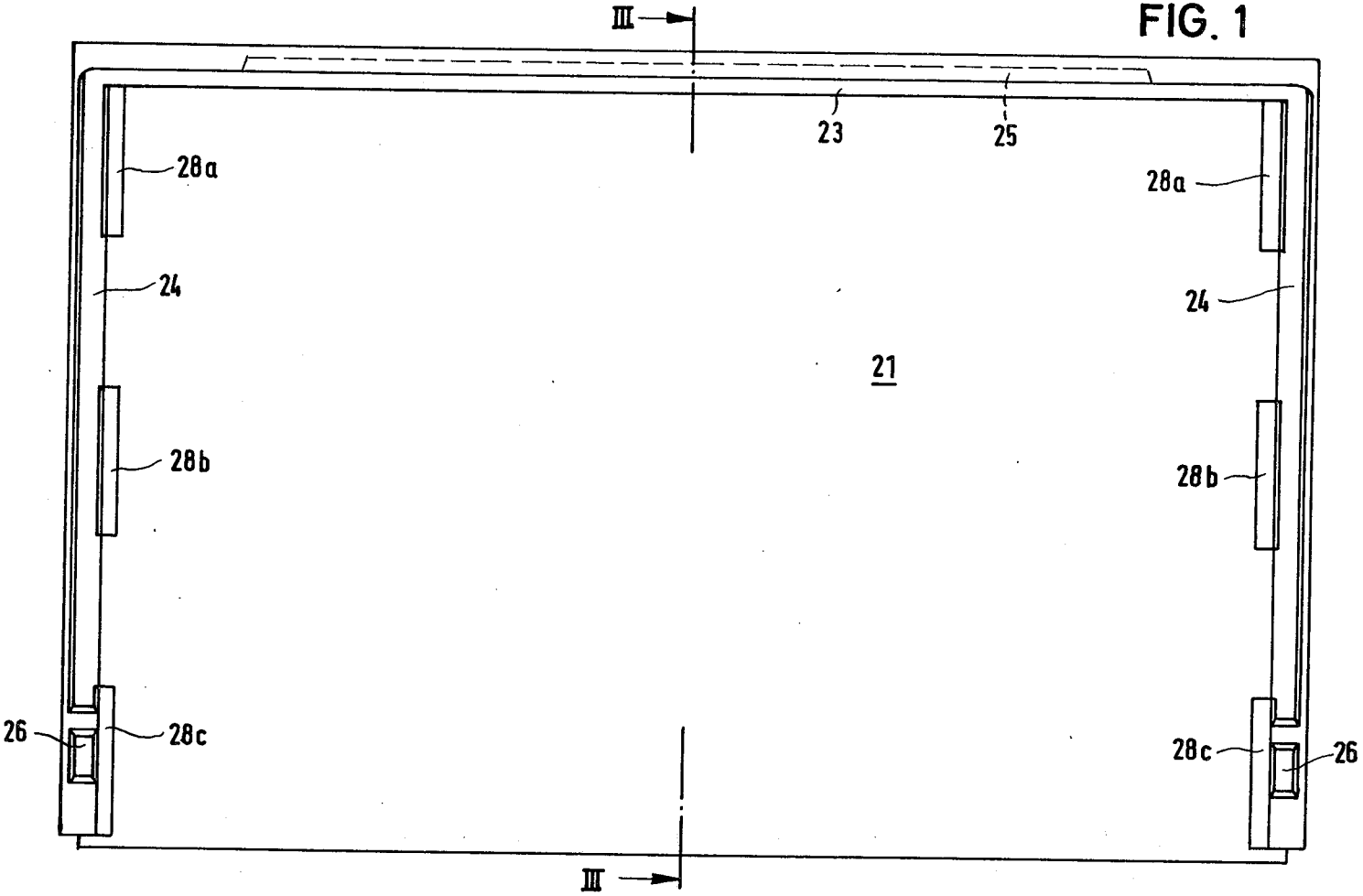
FIG. 1 shows a top view of a bottom wall of a coffer according to the invention.

The bottom wall shown in FIG. 1 to 4 comprises a bottom plate 21 having reinforcing ribs 22 and an integral U-shaped frame having a crosspiece 23 and two legs 24. The crosspiece 23 presents on its inner side a recess 25 having the shape of a groove extending over the major portion of the length of the crosspiece.

The thickness of the two legs 24 is larger adjacent their free ends than in the remaining portion, and in these thickened portions a recess 26 is provided the depth of which is equal to the size of the thickening. In the thickened portion there is provided a bore 27 parallel to the bottom plate 21, and below, in the actual leg, a shorter bore 28. At the outside of the leg and the crosspiece there is each provided a peripheral flange which extends so far beyond leg, and crosspiece, respectively, as the thickening at the face end of the legs.

At the inner side of the legs 24 each are provided three guide portions 28*a*, 28*b*, and 28*c*. For fabrication of the bottom wall out of plastic material equally sized apertures 29*a*, 29*b*, 29*c* are provided under such guide portions in the bottom plate 21, through which apertures dies for the lower side of the guiding means may extend.

Figure 5:
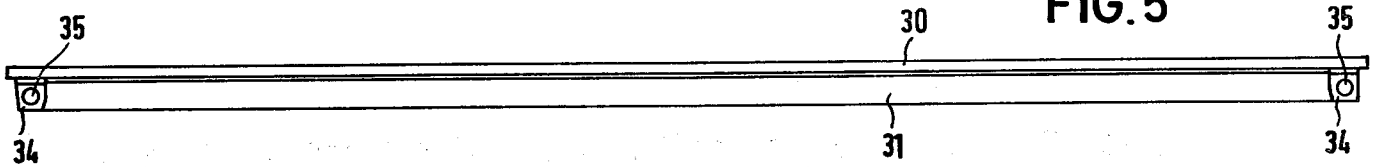
FIG. 5 shows a back view of the cover wall.
Figure 6:
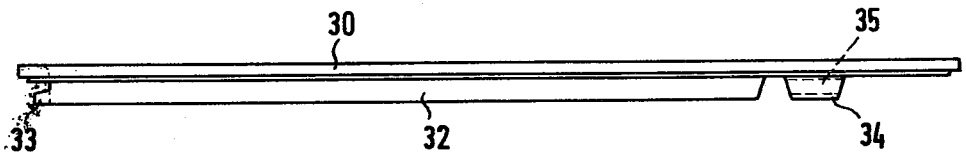
FIG. 6 shows a side view of the cover wall.

The cover wall shown in FIG. 5 and 6 comprises a cover plate 30, which conveniently is also provided with reinforcing ribs as the bottom plate 21, and an integral U-shaped frame comprising a crosspiece 31 and two legs 32. On the outer side of the crosspiece 31 there is provided a lug 33 which in shape and size is matched to the groove 25 in the inner side of the crosspiece 23 of the bottom wall according to FIG. 1 to 4.

The legs 32 are adapted to fit on the legs 24 of the bottom wall frame adjoining the peripheral flange and terminate where the thickening at the free end of the legs 24 of the bottom portion begins. Corresponding to the recess 26 in the thickening of the bottom wall leg 24 a projection 34 is provided which in shape and size is matched to the recess 26 and has a bore 35 corresponding to the bore 27.

Figure 7:
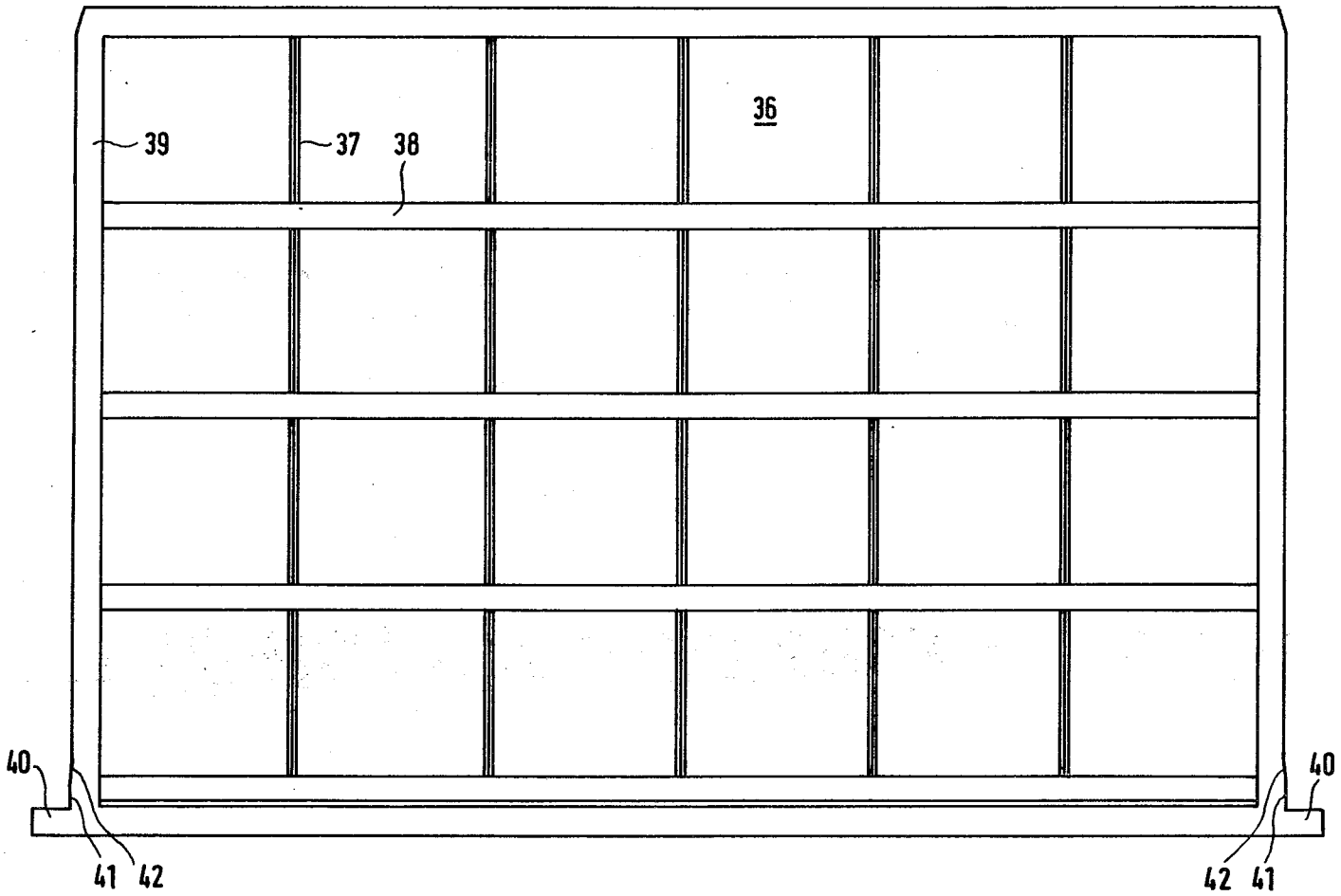
FIG. 7 shows a top view of a tablet for a coffer according to the invention.
Figure 8:
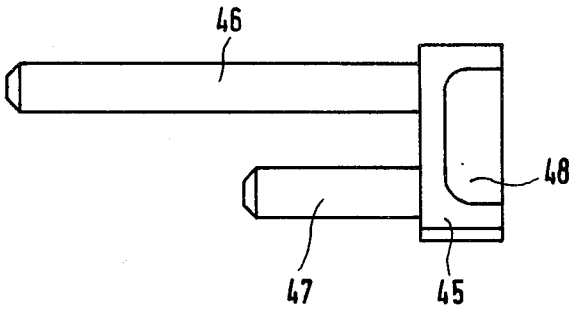
FIG. 8 shows a side view of a locking bolt.
Figure 9:
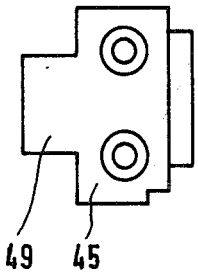
FIG. 9 shows a view of a locking bolt of FIG. 8 from the side of the bolt.
Figure 10:
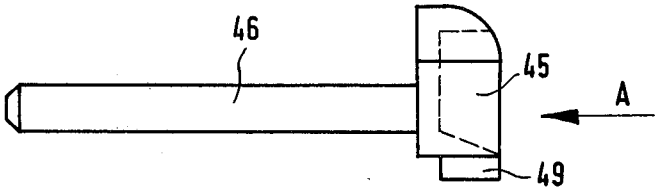
FIG. 10 shows a top view of a locking bolt of FIG. 8.
Figure 11:
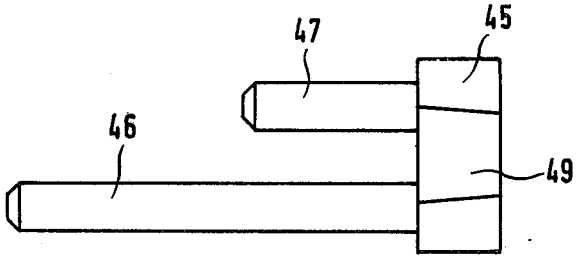
FIG. 11 shows a view of a locking bolt of FIG. 8 from the other side.

The coin tablet shown in FIG. 7 comprises a plate 36 which in the embodiment shown in the drawing is reinforced by partitions 37 and label carrying webs 38, and an integral supporting frame 39. On the outer face of the narrow sides of the rectangle formed by the frame 39 grooves are provided which are loosely fitted to the guiding means 24; such grooves are not shown for clarity.

At the rearward end of the tablet frame 39 short tapers are provided serving to facilitate insertion of the tablet into the frame. At the front end the tablet frame includes two laterally protruding lugs 40 which in the slid-in condition of the tablet extend across the front faces of the legs 24. Adjacent to the lugs 40 the frame 39 is slightly thickened for a short distance at 41, and this thickening blends into the frame via a 5° -taper 42.

The locking bolt shown in FIG. 8 to 11 comprises a head 45, the actual locking bolt 46, and a pin 47 parallel to the bolt 46. On the external side the head 45 presents a recess 48 and on the opposite side a leg 49 the dimensions of which are matched to that of the guiding portion 28*c*. The dimensions of the bolt 46 are matched to the bore 27 in the bottom portion, and 34 in the cover portion, respectively; the dimensions of the pin 47 are matched to those of the bore 28 in the bottom wall.

Figure 2:
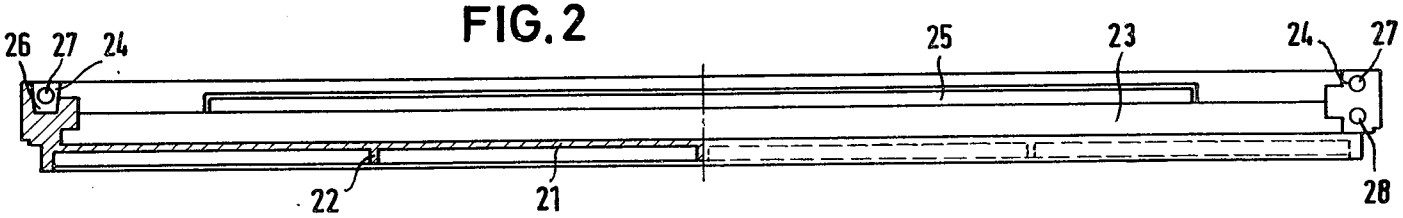
FIG. 2 shows a front view, partly in section, of the bottom wall of FIG. 1.
Figure 3:
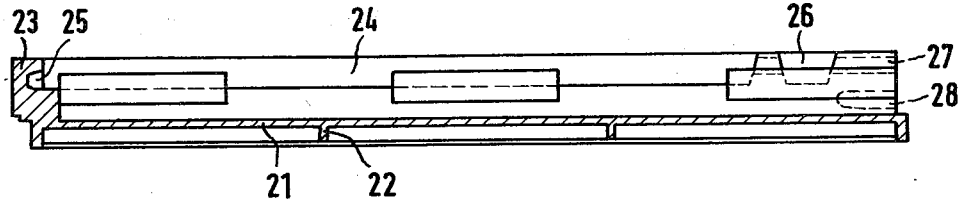
FIG. 3 shows a section along line III—III in FIG. 1.
Figure 4:
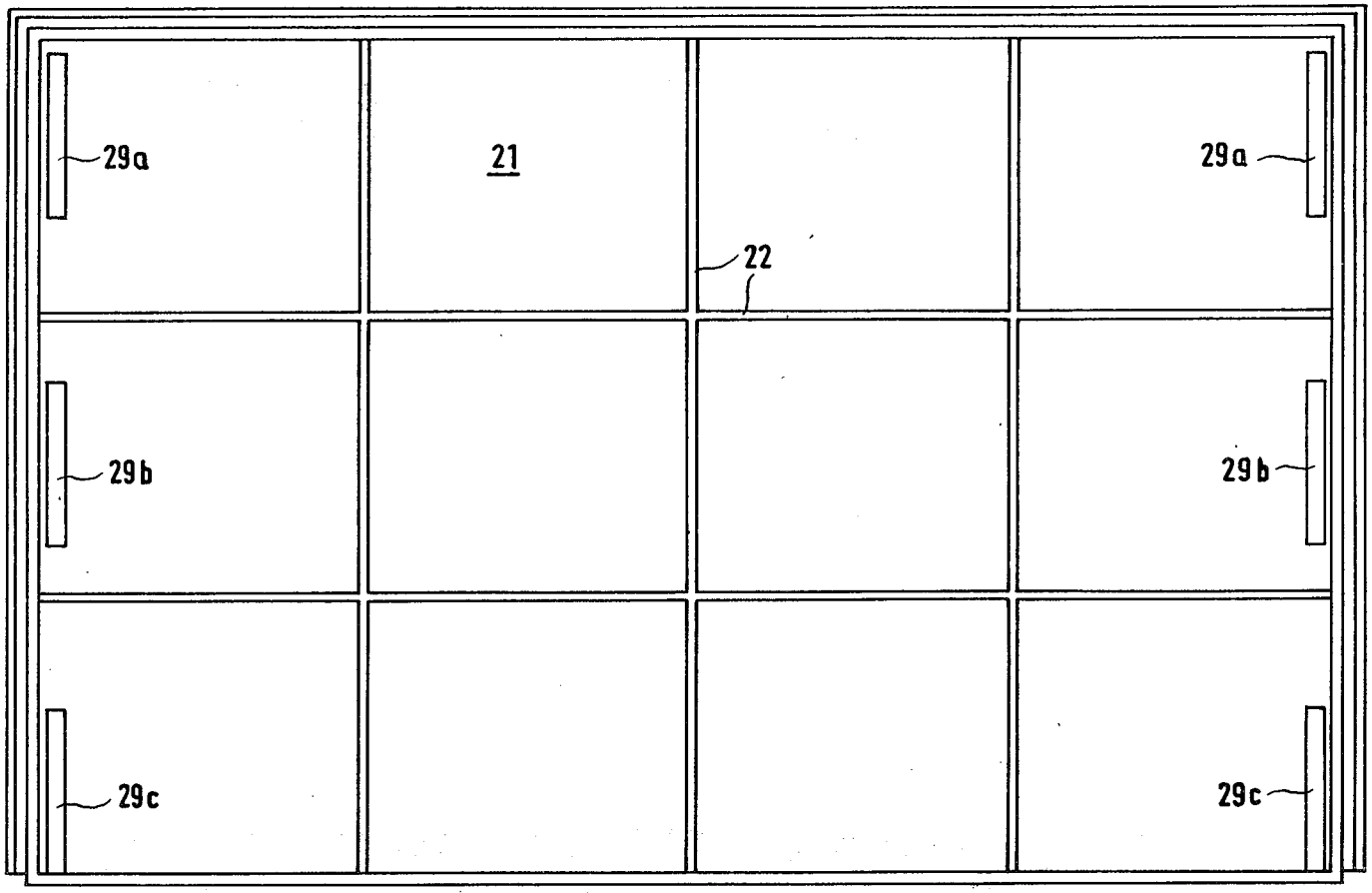
FIG. 4 shows a bottom view of the bottom wall of FIG. 1.

For assembling a coffer for a tablet according to FIG. 7 the lug 33 of the cover wall according to FIG. 5 and 6 is inserted into the groove 25 of the bottom wall according to FIG. 2 to 4, and then the cover wall is so flapped onto the bottom wall that the projection 34 engages recess 26. Thereafter the locking bolt according to FIG. 8 to 11 is inserted, i.e. the bolt 46 into the bore 27 of the bottom wall and into the bore 35 of the cover wall, and the pin 47 into the bore 28 of the bottom wall. The lock holds itself by frictional engagement in the bores, thus need not be fastened again. The locking bolt is made of another material, such as polypropylene, than the bottom and cover wall, which are made, for example, of polystyrene, so that inspite of frictional engagement no jamming of the locking bolt at the other portions may occur. The locking bolt thus may be withdrawn at any time, and the coffer disassembled, if desired.

Thereafter the tablet according to FIG. 7 is inserted in such a manner that the (not shown) guiding groove slides across the projections 49 of the heads of the two locking bolts on the right, and left, respectively, side, as well as the guiding means 28 in the frame of the bottom wall. Insertion is facilitated on the one hand by the tapers at the tablet and, on the other hand, by tapering the projection 49 in accordance with FIG. 11 and rounding its front edge according to FIG. 10. During insertion the tablet, on the major portion of its travel slides with ample clearance across the head of the locking bolt, only on the latter portion of the insertion way it is adjusted by the tapers 42 more exactly with respect to the two heads on the right and left, respectively, front face, until it engages frictionally the two heads 45 of the locking bolts during the last portion of its way corresponding to the thickening 41, so that it is maintained in its position by frictional engagement.

Figure 12:
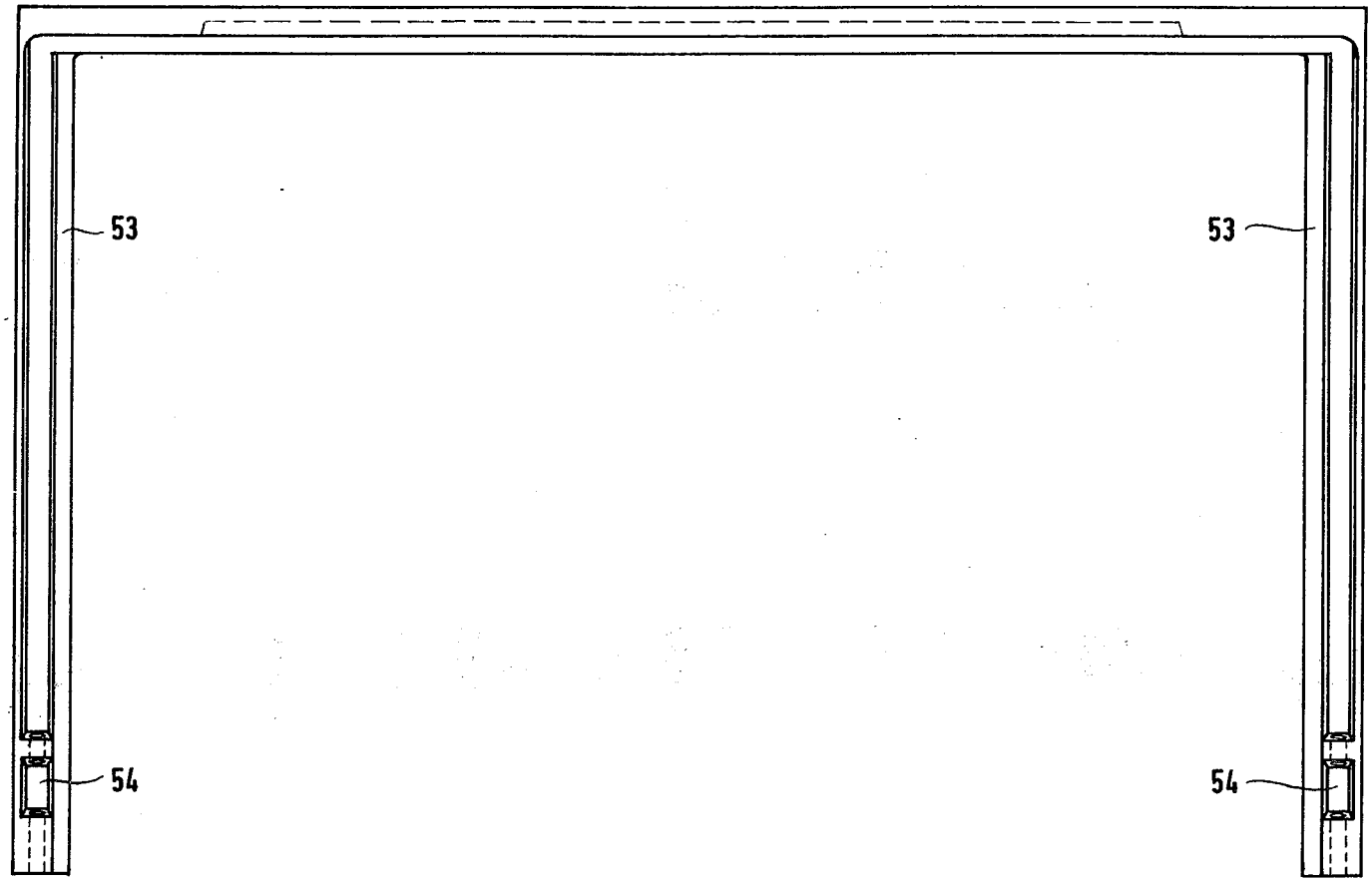
FIG. 12 shows a top view of a frame.
Figure 13:
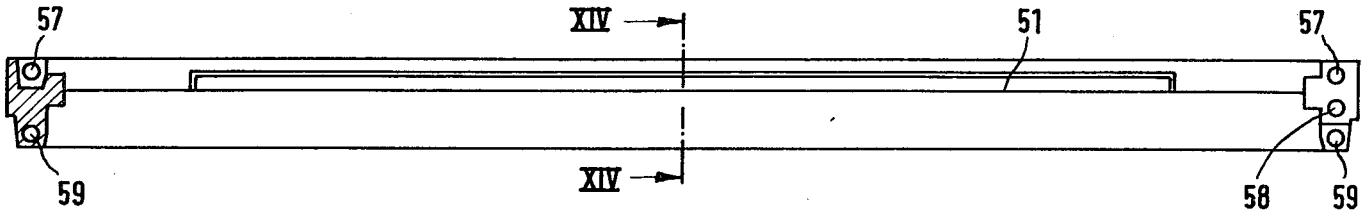
FIG. 13 shows a front view, partly in section, of a frame of FIG. 12.
Figure 14:
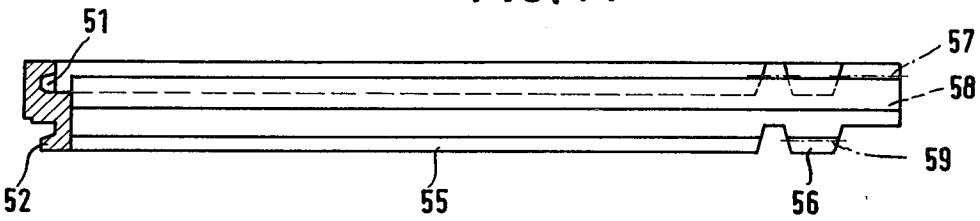
FIG. 14 shows a section along line XIV—XIV in FIG. 13.

The frame shown in FIG. 12 to 14 corresponds on its upper face to the frame of the bottom wall, and on its lower face it corresponds to the frame of the cover wall. Accordingly, the internal face of the crosspiece includes a groove 51 according to groove 25 of the frame of the bottom wall, and on the external face of the crosspiece it includes a lug 52 according to lug 33 of the cover wall.

The two legs present a guiding means 53 corresponding to guiding means 28*a* to 28*c* of the bottom wall, except that they are continuous, and at the front end there is provided a thickening having a recess 54 according to recess 26 of the bottom wall. On the outer side there is provided a continuous peripheral flange much as at the bottom wall, the height of which corresponds to that of the thickening.

On the lower face there is provided a flange 55 corresponding to flange 32 of the cover wall, as well as a projection 56 corresponding to the projection 34 of the cover wall adjacent to the front end. In the thickening two bores 57, and 58, respectively, corresponding to the bores 27 and 28 in the bottom wall, and in projection 56 a bore 59 corresponding to bore 53 of the cover wall are provided.

For enlarging a coffer comprising only a cover and a bottom wall to adapt the coffer for taking up another tablet, the locking bolts are removed, the cover portion is folded out, and its lug 33 removed from groove 25. Thereafter the lug 52 of the frame is inserted into the groove 25, and the frame is so folded onto the bottom wall that the projection 56 engages recess 26. In the same manner as described with respect to locking the cover portion thereafter on the right and the left side each a locking bolt is inserted, the locking bolt to be inserted on the right hand side being the mirror image of the one shown in FIG. 8 to 11, much as for locking the cover wall.

Thereafter the cover wall is put upon the frame according to FIG. 12 to 14 in the same manner as it was put on to the bottom wall, and then locked, and eventually the two tablets to be taken up are inserted in the manner described above.

In the same manner practically any number of frames for taking up one tablet each may be inserted between cover and bottom wall, and removed again as may be seen without further explanation.

Figure 15:
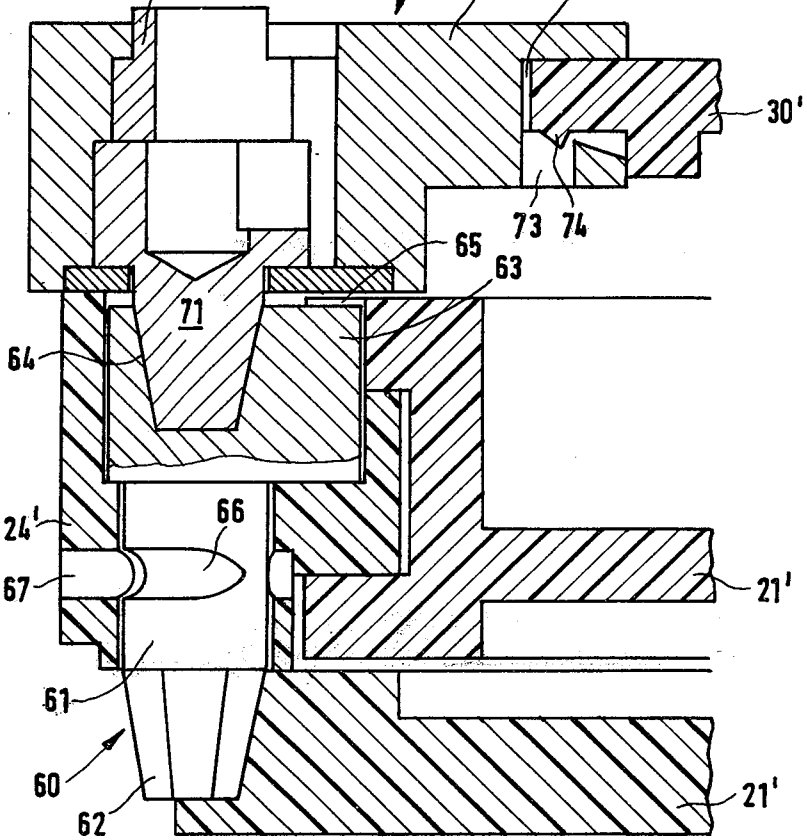
FIG. 15 shows a section through a leg of a U-shaped frame of a coffer according to FIG. 1 to 14 having a rotational locking means for the tablet.

FIG. 15 shows a section through a leg 24′ of a U-shaped frame integral with a bottom plate 21′ at a place in which a rotational lock 60 is inserted into the leg 24′, as well as the corresponding place of a cover plate 30′ and an inserted tablet 21′.

The actual rotational lock comprises a cylindrical pivot 61, a conical, hexagonal projection 62 extending downwardly, and a cam-shaped (FIG. 16) locking portion 63 which includes a conical, hexagonal recess 64 shaped according to the shape of the projection 62. In the rotational position shown in the drawing the protruding portion of the cam 63 extends into a recess 65 in the side edge of the tablet 21′ (FIG. 16) so that the tablet 21′ may not be removed from the frame.

In the cylindrical portion 61 of the rotational lock there is provided a groove 66 extending around a portion of the periphery, which nut corresponds to a bore 67 in the frame leg 24′ extending transversely to the axis of the rotational lock. A pin not shown for clarity may be inserted into said bore, which pin engages in each rotational position of the rotational lock into groove 66 and thus prevents any axial movement of the rotational lock 60.

A keylock 68 is disposed in the cover plate 30′, which lock comprises a housing 69 and a rotational portion 70; the remaining portion of the keylock as spring for defining the open, and closed position, respectively, tumbler, keyway or keyhole and the like are known and therefore need not be detailed here. A projection 71 identical to the projection 62 of the rotational lock and engaging into recess 64 in rotational lock 60, see FIG. 15, projects from the lower end of the rotational portion 70.

In the embodiment shown the solid portion 69 of the keylock 68 is provided with a peripheral slot 72 including an undercut 73 in a side wall. A nose 74 of the cover 30′ engages said undercut 73. When the lock 68 is inserted into the cover plate 30′ the nose 74 is at first pressed back thanks to the resiliency of the material of the cover 30′, and then snaps into the undercut 73 so that there is a positive fastening of the lock 68 within the cover plate 30′.

Figure 16:
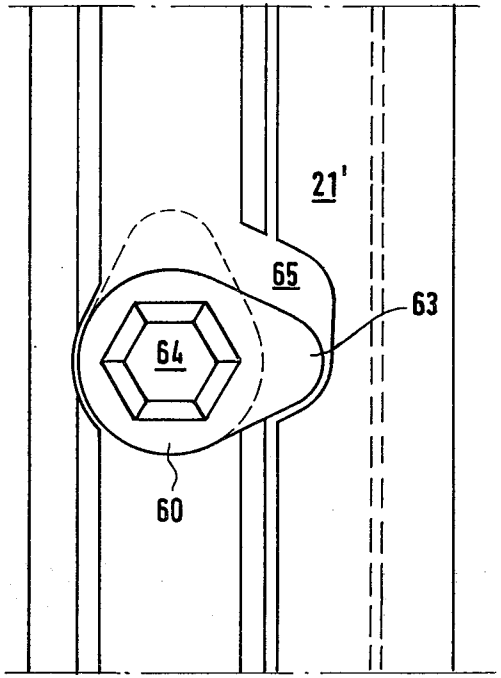
FIG. 16 shows a top view of the portions of a frame leg shown in section in FIG. 15 and having a rotational lock inserted.

The cover plate 30′ is put on the bottom portion 21′ including the frame 24′ in the same manner as described above, however with the addition that the rotational lock 60 and the rotating portion 70 of the lock 68 are brought into a predetermined position, for example the open position shown in FIG. 16 in broken lines. Since the two possible positions of the rotating portion 70 of the lock 68 are displaced by 90°, and the projection 71 and the recess 64 have hexagonal cross-section, projection 71 cannot completely engage recess 64 if and when a uniform rotational position is not obtained earlier. Assembly errors are thus prevented.

After assembly and insertion of a key into the rotational portion 70 of the lock 68 this may be brought into the other position, such as the locking position shown in solid lines in FIG. 16. Projection 71 drives, via positive engagement into recess 64, rotational lock 60.

If more than one U-shaped frame is to be utilized, the cover plate 30' need only be removed in the manner described above, the new U-shaped frame be inserted, and the cover plate 30' again be put upon same. Projection 71 of the rotational portion 70 of the lock 68 then engages into the rotational lock of the then inserted frame, and the corresponding projection 62 of this rotational lock then engages recess 64 of the rotational lock 60 in the bottom portion 21' which is shown here.

When the actual portions of the coffer, particularly the frames, are made of plastic, the rotational lock 60 and the keylock 68 are made conveniently of metal so that the key is adapted to transmit substantial turning moments into the lock and to transfer that onto a plurality of rotational locks, there being no danger for distorsions.

What we claim is:

1. A coffer for storing numismatical coins comprising a bottom wall, a cover wall, a set of U-shaped frames adapted for stacking, any preselected number of which can be stacked and releasably secured in fixed relation between said cover and bottom wall such that the legs and crosspiece of the individual U-shaped frames combine to define respectively side and back walls joining said bottom and cover walls, a set of coin holding tablets adapted to slidably engage any one or more of said U-shaped frames between the legs thereof whereby any number of U-shaped frames and tablets can be chosen from said sets of frames and tablets for assembling a coffer compatable with the size of the coin collection to be stored or for adding capacity to the coffer as required, and guide means on the legs of said frames for slidably supporting said tablets.

2. Coffer according to claim 1, in which the bottom wall is integral with one frame.

3. Coffer according to claim 1, in which the cover wall is integral with one frame.

4. Coffer according to claim 1, in which one frame is releasably positively connected to an adjacent member, the member being selected of the class comprising bottom wall, cover wall, and frame.

5. Coffer according to claim 4, in which at the crosspiece of each frame a lug is disposed in the plane of the frame, and a correspondingly shaped recess is provided in the opposite side of the crosspiece; the bottom wall and the cover wall presenting the same recess, and lug, respectively, and locking means are provided at the front side of the legs of each frame, the bottom wall, and the cover wall.

6. Coffer according to claim 5, in which each leg is provided with a recess adjacent the free end thereof, and on the opposite side a projection fitting into same, and at least in the leg portion between said recess and the free end, and the projection each have a bore parallel to the axis of the leg, a locking bolt being provided which fits into those bores.

7. Coffer according to claim 6, in which the locking bolt is made out of another material than the frame and the tablet.

8. Coffer according to claim 7, in which said locking bolt includes a head having a nose defining an extension of the tablet guiding means of a frame.

9. Coffer according to claim 8, in which each tablet fits loosely to the frame guiding means and fits closely to the head of the locking bolt.

10. Coffer according to claim 8, in which each locking bolt has means preventing rotation.

11. Coffer according to claim 10, in which said means preventing rotation comprises a pin fitting into a bore extending into the front side of the frame leg.

12. Coffer according to claim 1, in which in at least one leg of each U-shaped frame a rotational lock is provided which extends, in one of its rotational positions, into a recess at the side edge of the tablet, and which rotational lock presents on its upper face a recess having non-round cross-section, and on its lower face a projection shaped corresponding to the recess in the rotational lock of a frame disposed thereunder.

13. Coffer according to claim 12, in which a keylock is mounted at said cover wall, which lock has a projection shaped corresponding to the recess of a rotational lock disposed thereunder, and engaging same.

14. Coffer according to claim 12, in which each rotational lock is provided with a groove extending around a portion of its periphery, and a pin engaging said groove is inserted into each frame.

* * * * *